US008845023B2

(12) United States Patent
Chen et al.

(10) Patent No.: US 8,845,023 B2
(45) Date of Patent: Sep. 30, 2014

(54) CONVERTIBLE ROCKING CHAIR WITH MULTI-USING MODES

(75) Inventors: Ho-Sheng Chen, Chiayi County (TW); Chia-Ming Shen, Kaohsiung (TW); Yu-Chien Huang, New Taipei (TW)

(73) Assignee: Lerado (Zhong Shan) Industrial Co., Ltd., Zhong Shan, Guang Dong Province (CN)

( * ) Notice: Subject to any disclaimer, the term of this patent is extended or adjusted under 35 U.S.C. 154(b) by 349 days.

(21) Appl. No.: 13/359,927

(22) Filed: Jan. 27, 2012

(65) Prior Publication Data

US 2012/0193947 A1 Aug. 2, 2012

(30) Foreign Application Priority Data

Jan. 28, 2011 (CN) ..... 2011 2 0029309 U

(51) Int. Cl.

| | |
|---|---|
| ***A63G 13/06*** | (2006.01) |
| ***A47C 3/029*** | (2006.01) |
| ***A47C 20/02*** | (2006.01) |
| ***A47D 11/00*** | (2006.01) |
| ***A47D 13/10*** | (2006.01) |

(52) U.S. Cl.

CPC ..... *A47D 13/102* (2013.01); *A47D 11/002* (2013.01)

USPC ..... 297/258.1; 297/423.4; 297/440.16; 472/102

(58) Field of Classification Search

USPC ..... 297/258.1, 274, 423.45, 423.4, 423.19, 297/440.15, 440.16; 472/95, 101, 102

See application file for complete search history.

(56) References Cited

U.S. PATENT DOCUMENTS

| | | | | |
|---|---|---|---|---|
| 1,228,967 | A * | 6/1917 | Rho | 297/20 |
| 5,560,675 | A * | 10/1996 | Altheimer et al. | 297/33 |
| 5,868,459 | A * | 2/1999 | Welsh, Jr. | 297/32 |
| 6,161,847 | A * | 12/2000 | Howell et al. | 280/30 |
| 6,174,028 | B1 * | 1/2001 | Yang et al. | 297/258.1 |
| 6,361,106 | B1 * | 3/2002 | Huang | 297/32 |
| 6,439,656 | B1 * | 8/2002 | Liu | 297/33 |
| 6,682,137 | B2 * | 1/2004 | Hsia | 297/32 |
| 7,464,990 | B2 * | 12/2008 | Collias | 297/256.16 |
| 8,205,943 | B2 * | 6/2012 | Zhong | 297/274 |
| 8,567,867 | B2 * | 10/2013 | Arnold et al. | 297/383 |
| 2012/0274105 | A1 * | 11/2012 | Chen et al. | 297/183.1 |

* cited by examiner

*Primary Examiner* — David R Dunn
*Assistant Examiner* — Timothy J Brindley
(74) *Attorney, Agent, or Firm* — Muncy, Geissler, Olds & Lowe, P.C.

(57) ABSTRACT

A convertible rocking chair with multi-using modes comprises a base rack, an angle adjustable support element, a seat element, a repositionable mechanism and a backrest. The base rack has an end-stopper rotatably connected with one end, when the convertible rocking chair is used in a seat or bench mode, the end-stopper can be kept in an extended position for stopping the base rack from rocking against ground; and when the convertible rocking chair is used in the rocking chair mode or the rocking horse mode, the end-stopper can be kept in a hidden position for allowing the base rack to perform its rocking motion freely.

15 Claims, 10 Drawing Sheets

CONVERTIBLE ROCKING CHAIR WITH MULTI-USING MODES

BACKGROUND OF THE INVENTION

1. Field of the Invention

The present invention relates generally to a rocking chair; more particularly, to a rocking chair which is selectively convertible to a rocking chair mode, a seat or bench mode and a rocking horse mode.

2. Description of the Related Art

Traditional rocking chairs comprise a chair with arched rockers, in which the user can perform an arched rocking motion relative to the surface on which the rockers are standing.

There are no conventional infant rocking chairs is provided for adjustability from one configuration suitable for small infants to another configuration suitable for larger toddlers.

As a result, a problem with conventional rocking seats for infants is that during the rapid growing stage from infant to toddler, infant rocking chairs have a very short useable life span before the infant has outgrown the infant rocking chair.

Conventional infant rocking chairs also suffer from the disadvantage that they do not allow for simple and rapid disassembly or folding for storage without the use of tools.

SUMMARY OF THE INVENTION

To solve the mentioned problem, the present invention provides a convertible rocking chair with multi-using modes, comprising a base rack, an angle adjustable support element, a seat element, a repositionable mechanism and a backrest.

The backrest is detachably connected with the seat element; when the backrest is connected with the seat element, the convertible rocking chair can be used as a rocking chair mode 10; and when the backrest is removed from the seat element, the convertible rocking chair can be converted to a seat or bench mode and a rocking horse mode.

The base rack may have an end-stopper rotatably connected with one end or both ends of the base rack. When the convertible rocking chair is used in the seat or bench mode, the end-stopper is kept in an extended position for stopping the base rack from rocking against ground, and when the convertible rocking chair is used in the rocking chair mode 10 or the rocking horse mode, the end-stopper is kept in a hidden position for allowing the base rack to perform its rocking motion freely.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention; examples of which are illustrated in the accompanying drawings.

Figure 1:
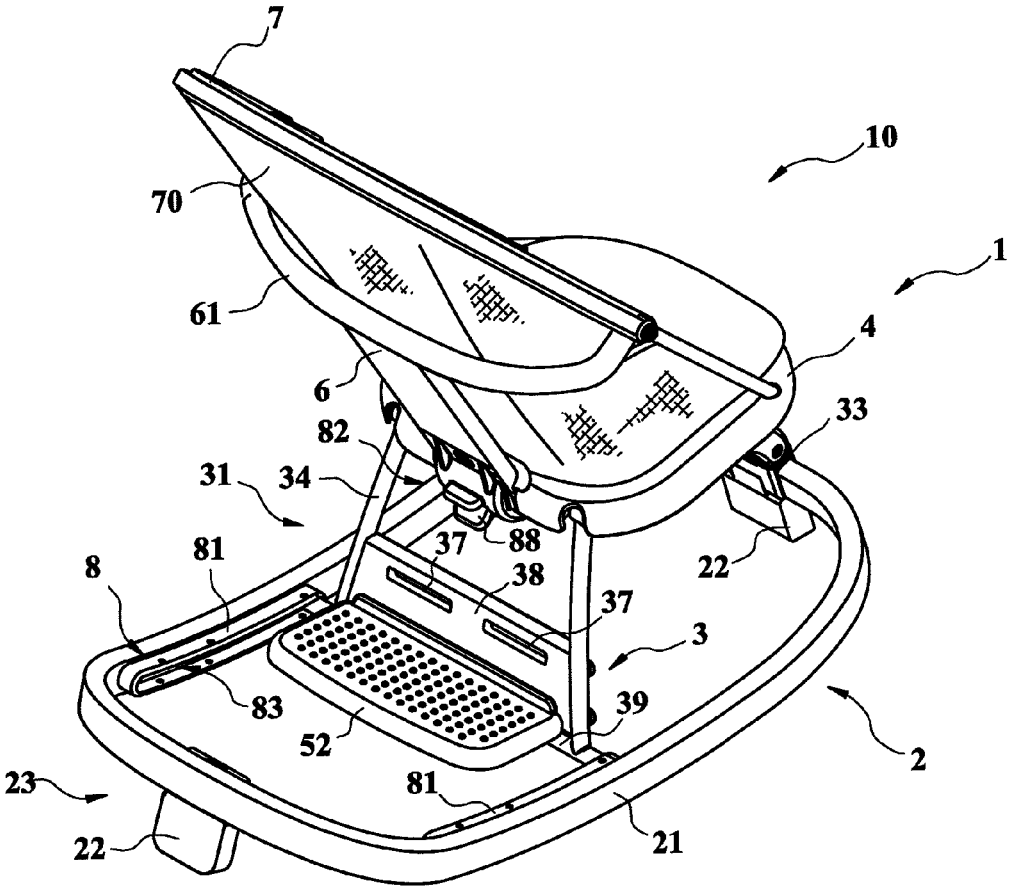
FIG. 1 is a perspective view showing a convertible rocking chair with multi-using modes according to the present invention.
Figure 2:
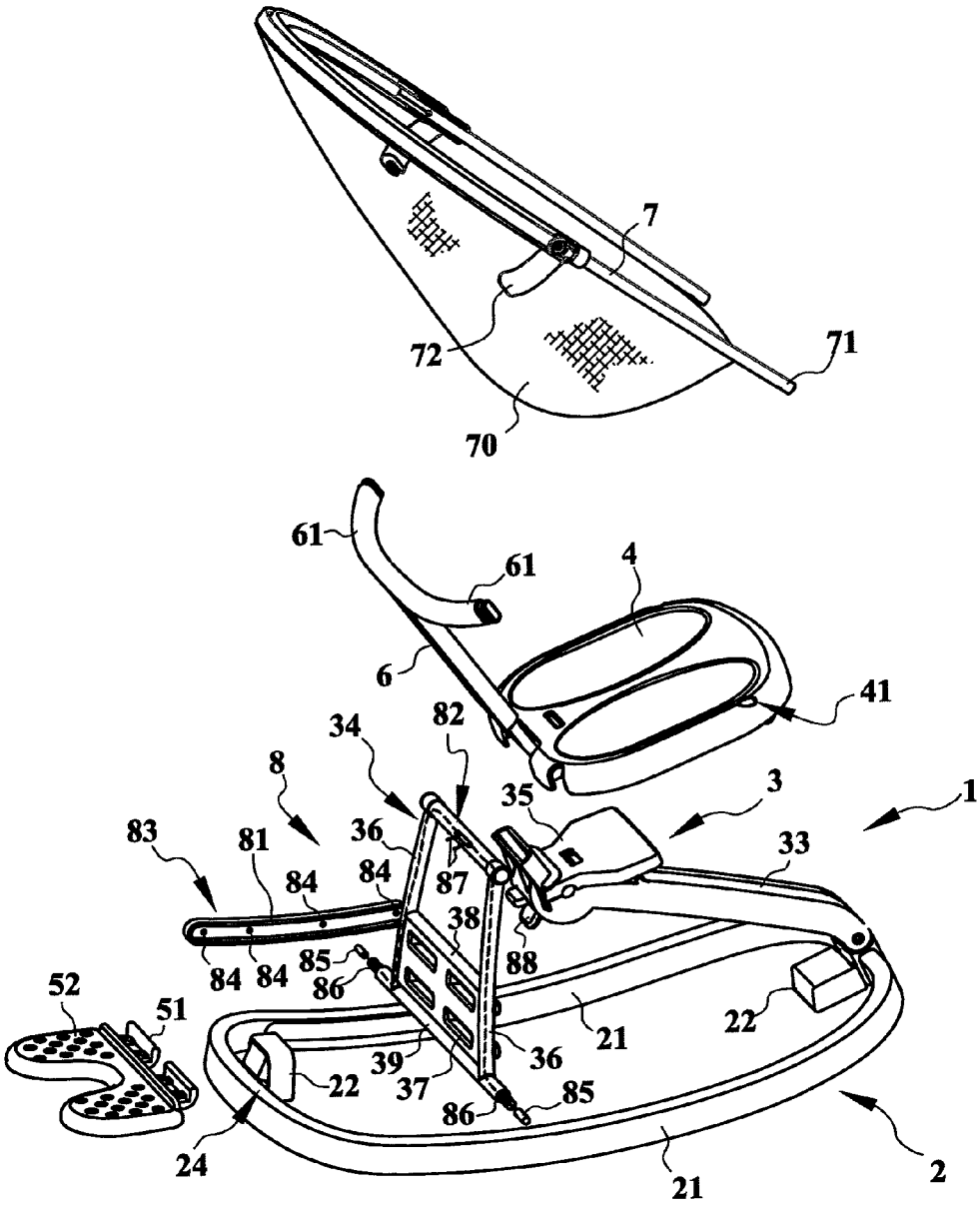
FIG. 2 is an exploded view showing the convertible rocking chair according to the present invention.

Referring to FIGS. 1 and 2, a preferred embodiment of the convertible rocking chair 1 with multi-using modes according to the present invention, comprises a base rack 2, an angle adjustable support element 3, a seat element 4, a repositionable mechanism 8 and a backrest 7.

The base rack 2 has an arched downside for rocking forward and rearward against ground. The base rack 2 may be formed as a substantially bended plate (not shown) having an arched downside for rocking forward and rearward against ground. Preferably, the base rack 2 may also be made of metal frame or tubes, which includes a pair of arched longitudinal tubes 21 each formed with an arched downside for rocking forward and rearward against ground.

Figure 3:
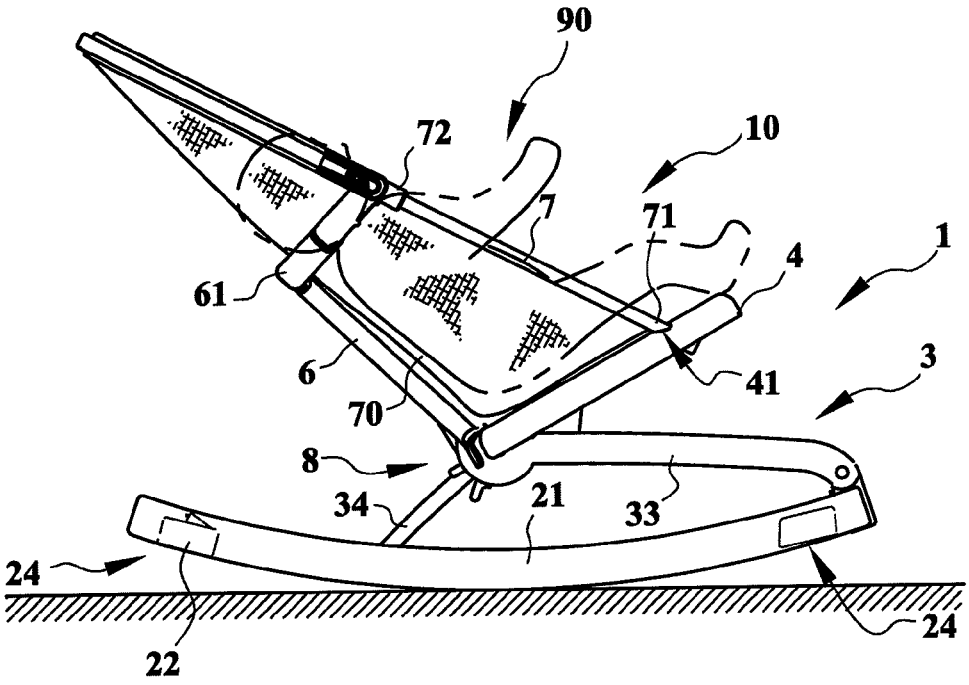
FIG. 3 is a schematic side view showing the convertible rocking chair converted to a rocking chair mode.
Figure 5:
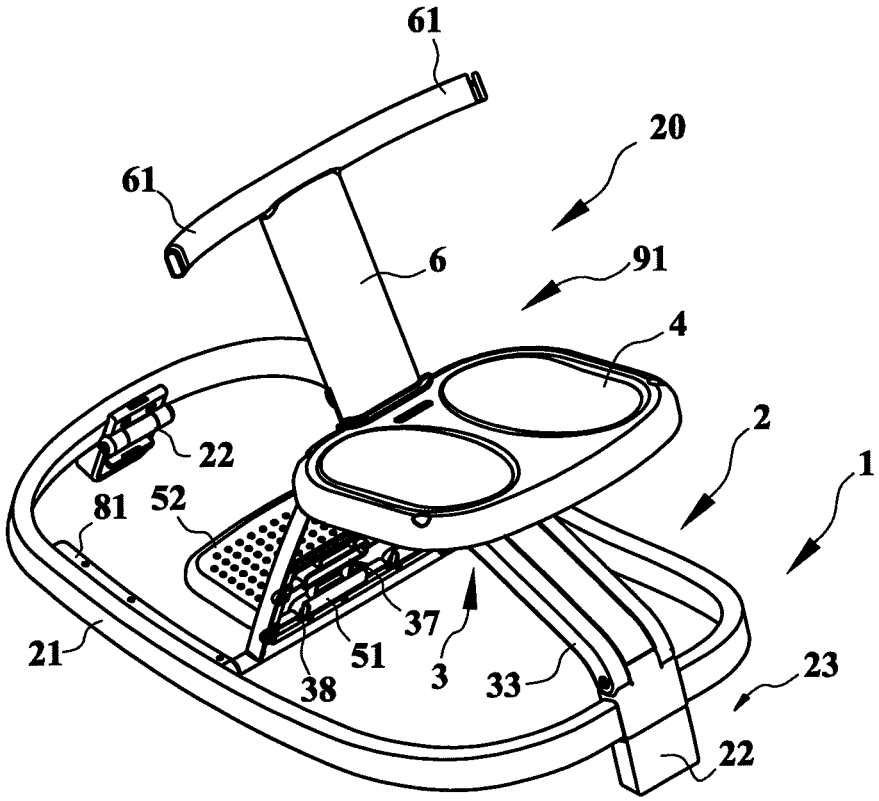
FIG. 5 is a perspective view showing the convertible rocking chair in a bench or normal seat mode.
Figure 6:
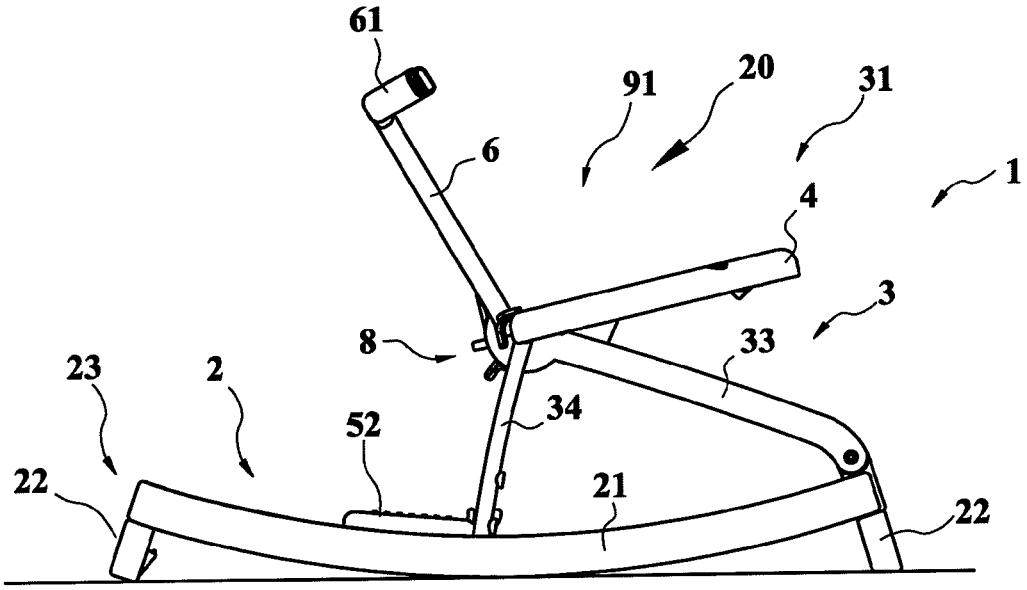
FIG. 6 is a side view showing the convertible rocking chair in a bench or normal seat mode.
Figure 7:
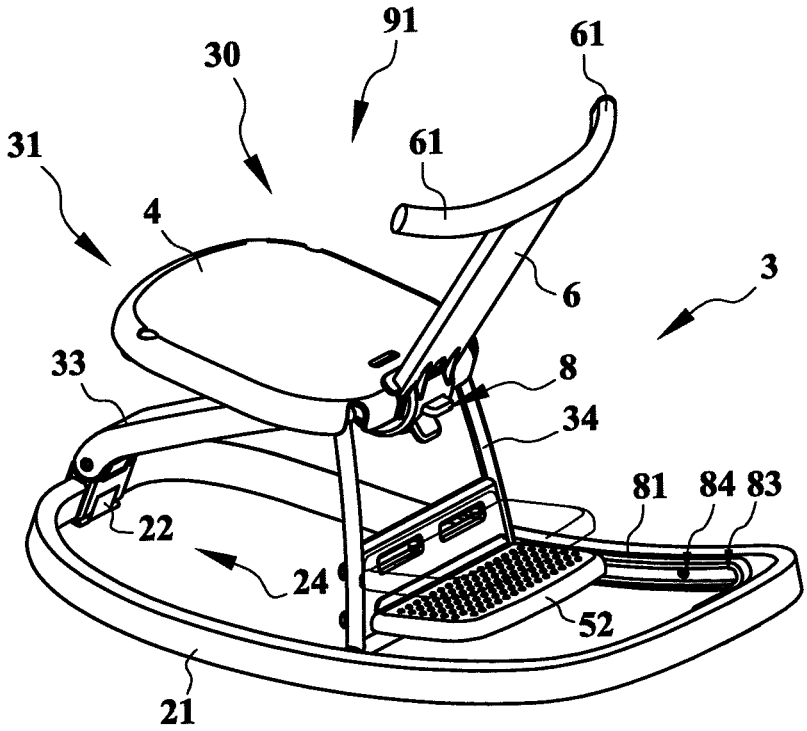
FIG. 7 is a perspective view showing the convertible rocking chair in a rocking horse mode.
Figure 8:
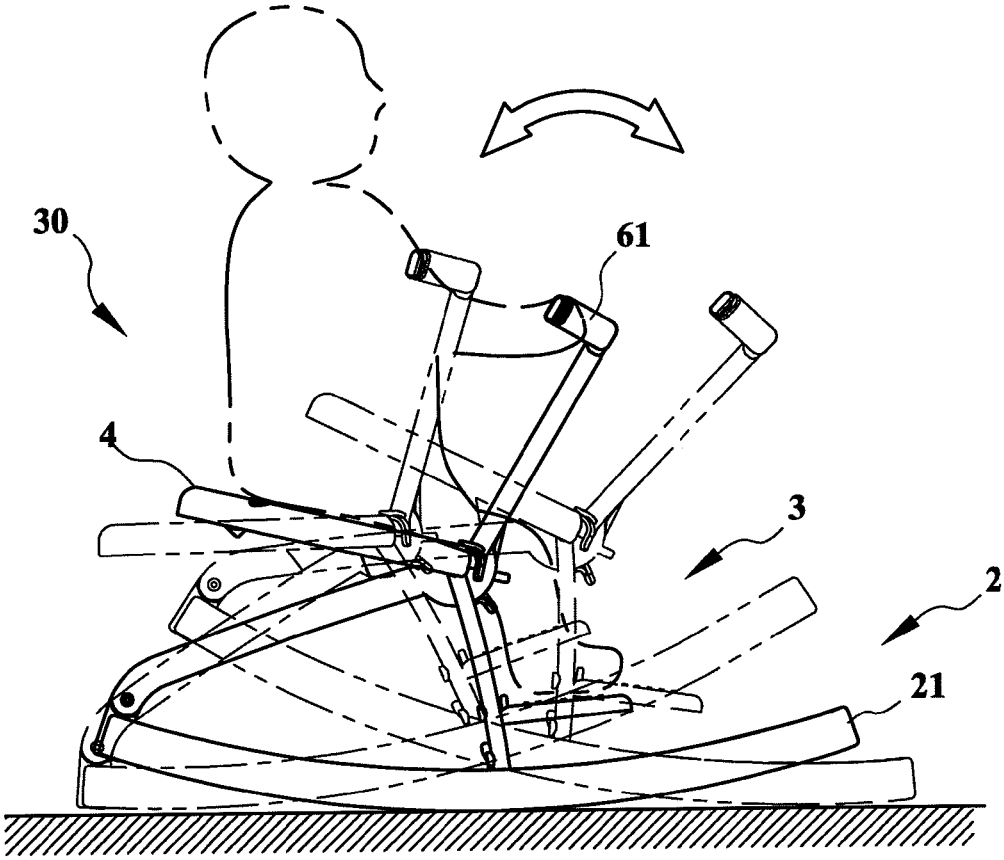
FIG. 8 is a side view showing the operation of the convertible rocking chair in a rocking horse mode.

The base rack 2 may further include at least an end-stopper 22 rotatably connected with one end or both ends of the base rack 2. Referring to FIGS. 5 and 6, the end-stopper 22 has an extended position 23 for stopping the base rack 2 from rocking against ground, and a hidden position 24 as shown in FIGS. 3, 7 and 8 for allowing the base rack 2 to rock against ground freely.

The angle adjustable support element 3 has a lower end adjustably connected to the base rack 2 and be foldable from a use position 31 to a folded position 32. The angle adjustable support element 3 may include a front strut 33 and a rear strut 34. In the embodiment, the front strut 33 is pivoted between the base rack 2 and the seat element 4; and the rear strut 34 may have an upper end pivoted to the seat element 4 and a lower end movably engaged with the base rack 2 for adjusting the seat element 4 in angles, as schematically shown in FIG. 4.

The front strut 33 may include a mount 35 for connecting with the seat element 4. The rear strut 34 may be formed as a frame having a pair of side tubes 36 and a transversal tube 39.

The rear strut 34 may further include a connecting portion 38 for mounting a foot pedal 52 thereon. Preferably, the connecting portion 38 may also include a plurality of sockets 37 formed on the rear strut 34 for inserting one hooked-end 51 of the foot pedal 52 to one of them, so as to install the foot pedal 52 on the rear strut 34 at a selected height.

Figure 4:
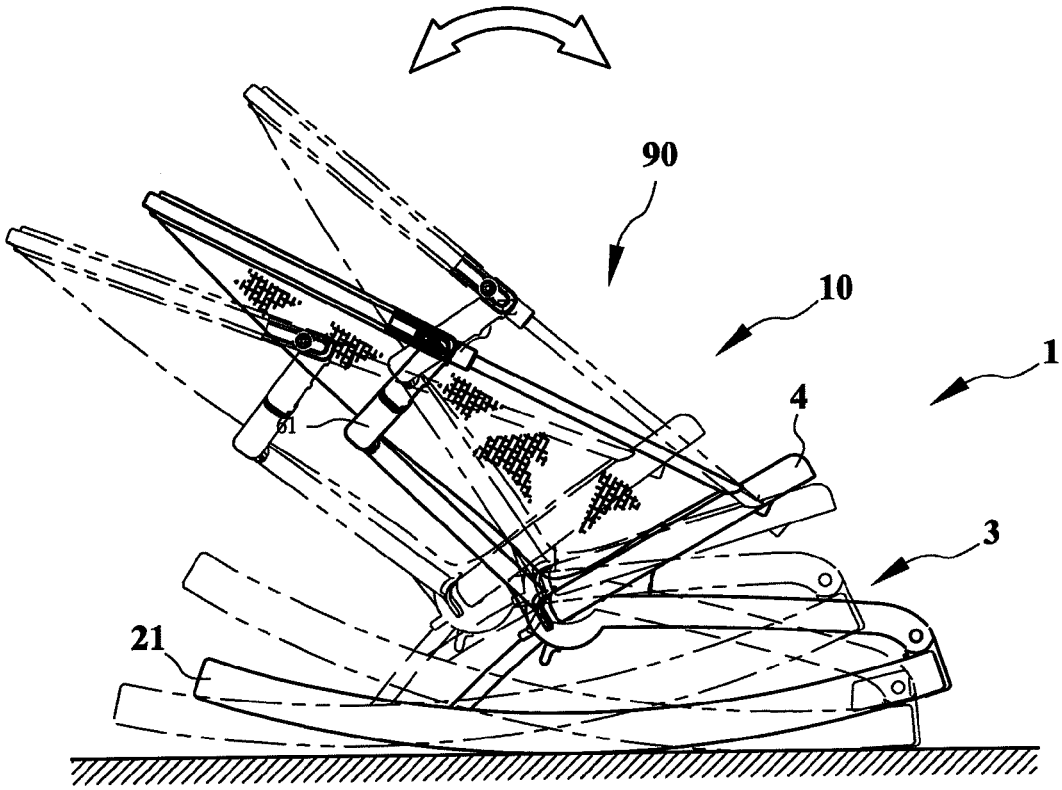
FIG. 4 is a schematic side view showing the operation for adjusting the convertible rocking chair in inclined angles.

The seat element 4 has a support stem 6 formed integrally or connected with a pair of handles 61 for gripping by hands and a lower portion connected to an upper end of the angle adjustable support element 3, so as to move and following the angle adjustable support element 3 to change in angles, providing at least a first inclination angle 90 as shown in FIG. 4 and a second inclination angle 91 as shown in FIGS. 6 and 7.

The seat element 4 may comprise at least a socket 41 for detachably installing the backrest 7, and the backrest 7 may be formed with at least a plug 71 for inserting into the socket 41 thereby detachably connecting the backrest 7 to the seat element 4.

The repositionable mechanism 8 is adjustably connected between the angle adjustable support element 3 and the base rack 2 for adjusting the seat element 4 in incline angles as shown in FIG. 4. The repositionable mechanism 8 may include a guiding element 81 and a release mechanism 82. The guiding element 81 may be mounted on the base rack 2 as shown in the embodiment of FIG. 2, formed with a guiding groove 83 for guiding and locking the lower end of the rear strut 34.

The release mechanism 82 is used to manipulate for unlocking the lower end of the rear strut 34 to reposition the rear strut 34 thereby adjusting the seat element 4 in incline angles. The guiding groove 83 is formed with a plurality of positioning holes 84 for engaging with a spring biased locking element 85 which installed at the lower end of the rear strut 34 under a biasing force from a spring 86.

The release mechanism 82 of this embodiment, may alternatively include an actuator 88, a spring biased locking element 85 and an associating element 87. The actuator 88 is operatively mounted on any hand-accessible portion of the convertible rocking chair 1. The actuator 88 may be a single element connected with two associating elements 87 and two spring-biased locking elements 85 for facilitating user to use one hand to disengage the spring-biased locking elements 85 from the predetermined position simultaneously.

Figure 10:
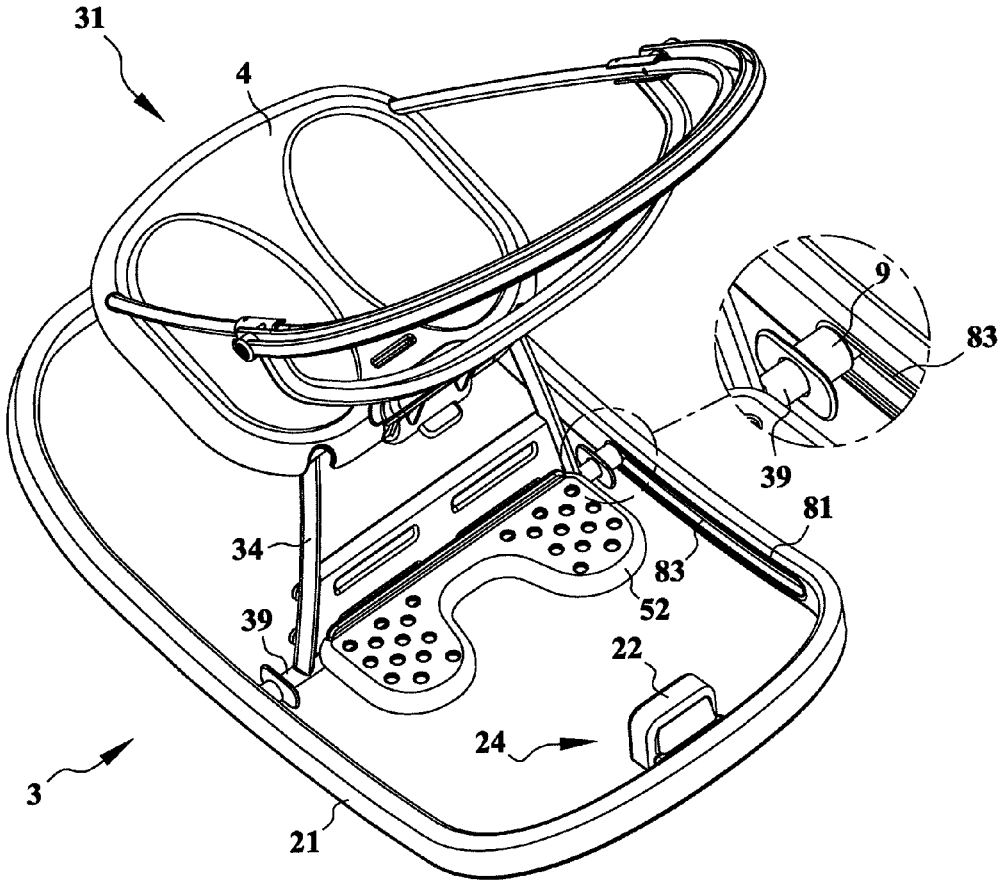
FIG. 10 is an alternative embodiment the convertible rocking chair with multi-using modes according to the present invention.

The actuator 88 may also be composed of two elements that permit two hands to disengage two spring-biased locking elements 85 from the predetermined position separately. Referring to FIG. 10, an alternative embodiment of the actuator 88 includes two sliding elements 9 mounted at the lower end of the rear strut 34 for disengaging two spring-biased locking elements 85 from a position.

The spring biased locking element 85, may be retractively mounted on the lower end of the rear strut 34 for engaging within the guiding groove 83 in at least a predetermined position. The associating element 87 interconnected between the actuator 88 and the spring biased locking element 85, by this way, to disengage the spring biased locking element 85 from the position.

The backrest 7 is detachably connected with the seat element 4. Preferably, the backrest 7 may include a U-shaped frame covered with a layer of webbing material 70. The distal ends of the U-shaped frame may be formed as a pair of plugs 71 for inserting into two sockets 41 for detachably connecting the backrest 7 to the seat element 4. The backrest 7 may further include a connecting element 72 for detachably securing the backrest 7 to the handles 61 of the support stem 6.

When the backrest 7 is connected with the seat element 4, the convertible rocking chair can be used as a rocking chair mode 10 as shown in FIGS. 3 and 4; and when the backrest 7 is removed from the seat element 4, the convertible rocking chair can be converted to a seat or bench mode 20 as shown in FIGS. 5 and 6, and a rocking horse mode 30 as shown in FIGS. 7 and 8.

Figure 9:
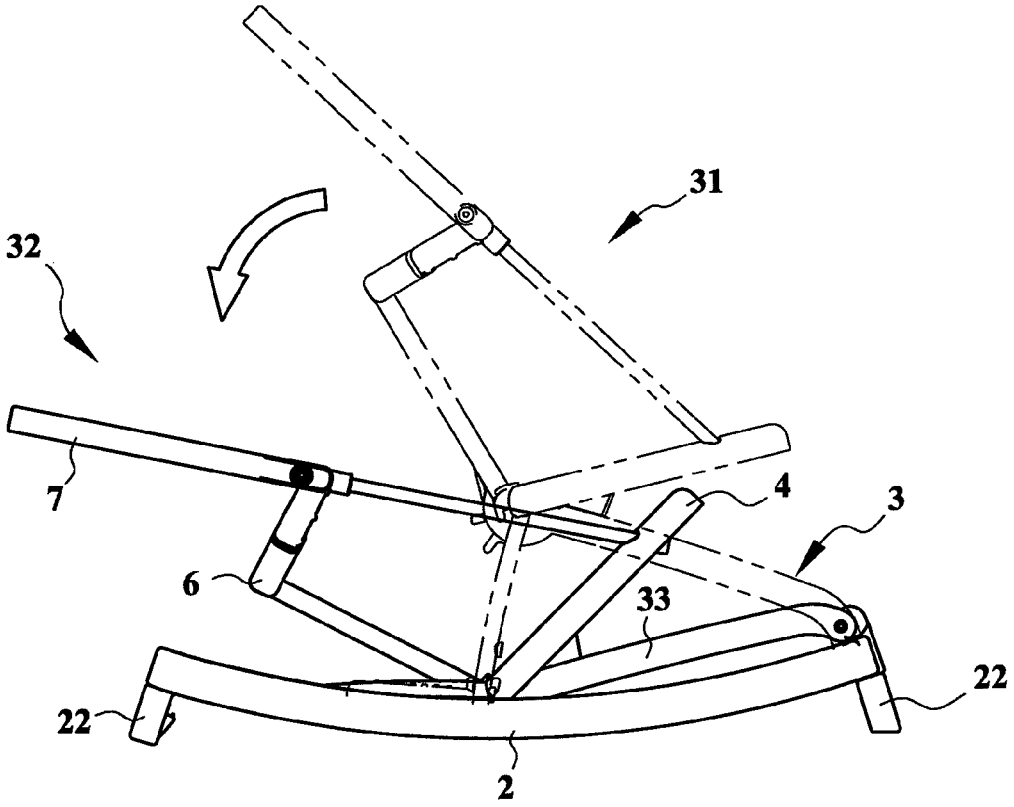
FIG. 9 is a side view showing the operation of folding the convertible rocking chair.

Referring to FIG. 9, the convertible rocking chair 1 may be foldable by manipulating the release mechanism 82 to disengage the spring biased locking element 85 and release the lower end of the rear strut 34 to slide along the guiding groove 83, by this way to lower the seat element 4.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A convertible rocking chair with multi-using modes, comprising at least:

a base rack, having an arched downside for rocking forward and rearward against ground;

an angle adjustable support element, having a lower end adjustably connected to the base rack and being foldable from a use position to a folded position;

a seat element, having a support stem connected with a pair of handles for gripping by hands and a lower portion connected to an upper end of the angle adjustable support element, so as to move following the angle adjustable support element;

a repositionable mechanism, adjustably connected between the angle adjustable support element and the base rack for adjusting the seat element in incline angles; and a backrest detachably connected with the seat element; when the backrest is connected with the seat element, the convertible rocking chair can be used as a rocking chair mode; and when the backrest is removed from the seat element, the convertible rocking chair can be converted to a seat or bench mode and a rocking horse mode, wherein the seat element has at least a socket, and the backrest has at least a plug for inserting into the socket thereby detachably connecting the backrest to the seat element.

2. The convertible rocking chair with multi-using modes of claim 1, wherein the base rack is substantially a bended plate formed with the arched downside for rocking forward and rearward against ground.

3. The convertible rocking chair with multi-using modes of claim 1, wherein the base rack comprises a pair of arched longitudinal tubes formed with the arched downside for rocking forward and rearward against ground.

4. The convertible rocking chair with multi-using modes of claim 1, wherein the base rack further includes an end-stopper rotatably connected with one end of the base rack, the end-stopper has an extended position for stopping the base rack from rocking against ground, and a hidden position for allowing the base rack to rock against ground.

5. The convertible rocking chair with multi-using modes of claim 1, wherein the backrest further includes a connecting element for detachably securing the backrest to the handles.

6. The convertible rocking chair with multi-using modes of claim 1, wherein the backrest includes a U-shaped frame covered with a layer of webbing material.

7. The convertible rocking chair with multi-using modes of claim 1, wherein the angle adjustable support element includes:

a front strut pivoted between the base rack and the seat element; and a rear strut having an upper end pivoted to the seat element and a lower end movably engaged with the base rack for adjusting the seat element in angles.

8. A convertible rocking chair with multi-using modes, comprising at least:

a base rack, having an arched downside for rocking forward and rearward against ground;

an angle adjustable support element, having a lower end adjustably connected to the base rack and being foldable from a use position to a folded position;

a seat element, having a support stem connected with a pair of handles for gripping by hands and a lower portion connected to an upper end of the angle adjustable support element, so as to move following the angle adjustable support element;

a repositionable mechanism, adjustable connected between the angle adjustable support element and the base rack for adjusting the seat element in incline angles; and a backrest detachably connected with the seat element; when the backrest is connected with the seat element, the convertible rocking chair can be used as a rocking chair mode; and when the backrest is removed from the seat element, the convertible rocking chair can be converted to a seat or bench mode and a rocking horse mode, wherein the angle adjustable support element includes:

a front strut pivoted between the base rack and the seat element; and a rear strut having an upper end pivoted to the seat element and a lower end movably engaged with the base rack for adjusting the seat element in angles, and wherein the rear strut includes a connecting portion for mounting a foot pedal thereon.

9. The convertible rocking chair with multi-using modes of claim 8, wherein the connecting portion comprises a plurality of sockets for connecting the foot pedal to the rear strut.

10. The convertible rocking chair with multi-using modes of claim 7, wherein the repositionable mechanism includes:

a guiding element mounted on the base rack, formed with a guiding groove for guiding and locking the lower end of the rear strut; and a release mechanism for unlocking the lower end of the rear strut, so as to reposition the rear strut and adjust the seat element in incline angles.

11. The convertible rocking chair with multi-using modes of claim 10, wherein the release mechanism includes:

an actuator, operatively mounted on the convertible rocking chair, a spring biased locking element, retractively mounted on the lower end of the rear strut for engaging with the guiding groove in least a predetermined position; and an associating element interconnected between the actuator and the spring biased locking element, thereby disengaging the spring biased locking element from the predetermined position.

12. The convertible rocking chair with multi-using modes of claim 11, wherein the actuator is a single element that permits one hand operation to disengage the spring biased locking element from the predetermined position.

13. The convertible rocking chair with multi-using modes of claim 11, wherein the actuator includes two elements that permit two hands operation to disengage the spring biased locking element from the predetermined position.

14. The convertible rocking chair with multi-using modes of claim 11, wherein the guiding groove is formed with a plurality of positioning holes for engaging with the spring biased locking element.

15. The convertible rocking chair with multi-using modes of claim 11, wherein the actuator is a sliding element mounted on the lower end of the rear strut for disengaging the spring biased locking element from the predetermined position.

* * * * *